US007532847B2

(12) United States Patent
Washino et al.

(10) Patent No.: US 7,532,847 B2
(45) Date of Patent: May 12, 2009

(54) IMAGE FORMING APPARATUS HAVING FIXING UNITS THEREOF

(75) Inventors: Shigeki Washino, Kanagawa (JP); Yutaka Nogami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/907,830

(22) Filed: Oct. 17, 2007

(65) Prior Publication Data

US 2008/0166161 A1 Jul. 10, 2008

(30) Foreign Application Priority Data

Jan. 9, 2007 (JP) ..... 2007-001496

(51) Int. Cl.
*G03G 15/20* (2006.01)

(52) U.S. Cl. ..... 399/329; 399/341

(58) Field of Classification Search ..... 399/329, 399/341; 219/216

See application file for complete search history.

(56) References Cited

U.S. PATENT DOCUMENTS

| | | | | |
|---|---|---|---|---|
| 4,780,742 | A * | 10/1988 | Takahashi et al. | 430/124.13 |
| 5,235,393 | A * | 8/1993 | Merle | 399/341 |
| 5,339,146 | A * | 8/1994 | Aslam et al. | 430/47.5 |
| 6,011,947 | A * | 1/2000 | Acquaviva et al. | 399/341 |
| 6,249,667 | B1 * | 6/2001 | Acquaviva et al. | 399/406 |
| 6,363,238 | B1 * | 3/2002 | Spencer et al. | 399/406 |
| 7,324,779 | B2 * | 1/2008 | Anderson et al. | 399/341 |
| 2005/0244203 | A1 * | 11/2005 | Kamiyama | 399/341 |

FOREIGN PATENT DOCUMENTS

| | | |
|---|---|---|
| JP | H05-019642 | 1/1993 |
| JP | H07-114239 | 5/1995 |
| JP | 2001-265158 | 9/2001 |
| JP | 2002-091048 | 3/2002 |
| JP | 2002-099168 | 4/2002 |
| JP | 2003-270991 | 9/2003 |
| JP | 2004-151269 | 5/2004 |
| JP | 2005-099122 | 4/2005 |
| JP | 2005-114832 | 4/2005 |

OTHER PUBLICATIONS

Japanese Office Action dated Jul. 31, 2007 in Japanese Appl. No. 2007-001496 and its English translation.

* cited by examiner

*Primary Examiner*—Quana M Grainger
(74) *Attorney, Agent, or Firm*—Morgan, Lewis & Bockius LLP

(57) ABSTRACT

A fixing apparatus includes: a first fixing unit; and a second fixing unit, the first fixing unit including: a first heating member; a first fixing belt, a first pressure member; a first separation member; and a first cooling member, the second fixing unit provided in a downstream of a sheet path with respect to the first fixing unit, the second fixing unit including: a second heating member; a second fixing belt, a second pressure member, provided in opposing relation to the second heating member, that is pressed to the second fixing belt, the second fixing belt being sandwiched by the second pressure member and the second heating member, a vertical position of a rotation axis of the second pressure member being lower than a vertical position of a rotation axis of the second heating member; a second separation member; and a second cooling member.

6 Claims, 6 Drawing Sheets

1
21
22
22D
22E
22A
22B
22C
22F
22G
20
50
100
110
111
112
113
114
115
116
120
121
122
123
124
125
126
130a
130b
130c
130d
130e
130f
140a
140b
11
12
13
14
14M
14C
14K
14Y
14F
15
16
17
18
19
23
40
41
42
42a
42b
43a
43b
34a
34b
34c
34d
34e
34f
34g
34h
34i
34j
S
S'
60
30
31a
31b
31c
311a
311b
311c
P1
P2
P3
P4
321
32

IMAGE FORMING APPARATUS HAVING FIXING UNITS THEREOF

CROSS-REFERENCE TO RELATED APPLICATIONS

This application is based on and claims priority under 35 USC 119 from Japanese Patent Application No. 2007-1496 filed on Jan. 9, 2007.

BACKGROUND

1. Technical field

The present invention relates to a fixing apparatus, post-processing apparatus, and image forming apparatus.

2. Related Art

There is known a type of fixing apparatus for fixing an image on a sheet using a colorant, in which an endless conveyer belt for carrying the sheet is employed. In such apparatus, a sheet having an image formed on it is heated and pressed so as to adhere the sheet to the belt. Next, the sheet and the belt are cooled so as to separate the sheet from the belt. Since the colorant on the sheet is smooth due to having been pressed against a surface of the belt, a gloss is imparted to the sheet after it is separated from the belt.

SUMMARY

According to an aspect of the invention, there is provided a fixing apparatus comprising: a first fixing unit; and a second fixing unit, the first fixing unit comprising: a first heating member, that includes a heat source and rotates; a first fixing belt, rotatably contacted with the first heating member, that carries a sheet, contacting a face of the sheet, on which face an image is formed; a first pressure member that is provided in opposing relation to the first heating member and is pressed to the first fixing belt, the first fixing belt being sandwiched by the first pressure member and the first heating member; a first separation member contacting the first fixing belt, that separates the sheet carried by the first fixing belt from the first fixing belt; and a first cooling member, disposed between the first separation member and the first heating member, that cools the first fixing belt by contacting the first fixing belt; the second fixing unit comprising: a second heating member, provided in a downstream of a sheet path with respect to the first fixing unit, that includes a heat source and rotates; a second fixing belt, rotatably contacted with the second heating member, that carries a sheet, contacting another face of the sheet, a second pressure member, provided in opposing relation to the second heating member, that is pressed to the second fixing belt, the second fixing belt being sandwiched by the second pressure member and the second heating member, a vertical position of a rotation axis of the second pressure member being lower than a vertical position of a rotation axis of the second heating member; a second separation member contacting the second fixing belt, that separates the sheet carried by the second fixing belt from the second fixing belt; and a second cooling member, disposed between the second separation member and the second heating member, that cools the second fixing belt by contacting the second fixing belt.

BRIEF DESCRIPTION OF THE DRAWINGS

Exemplary embodiment(s) of the present invention will be described in detail based on the following figures, wherein.

DETAILED DESCRIPTION

Figure 1:
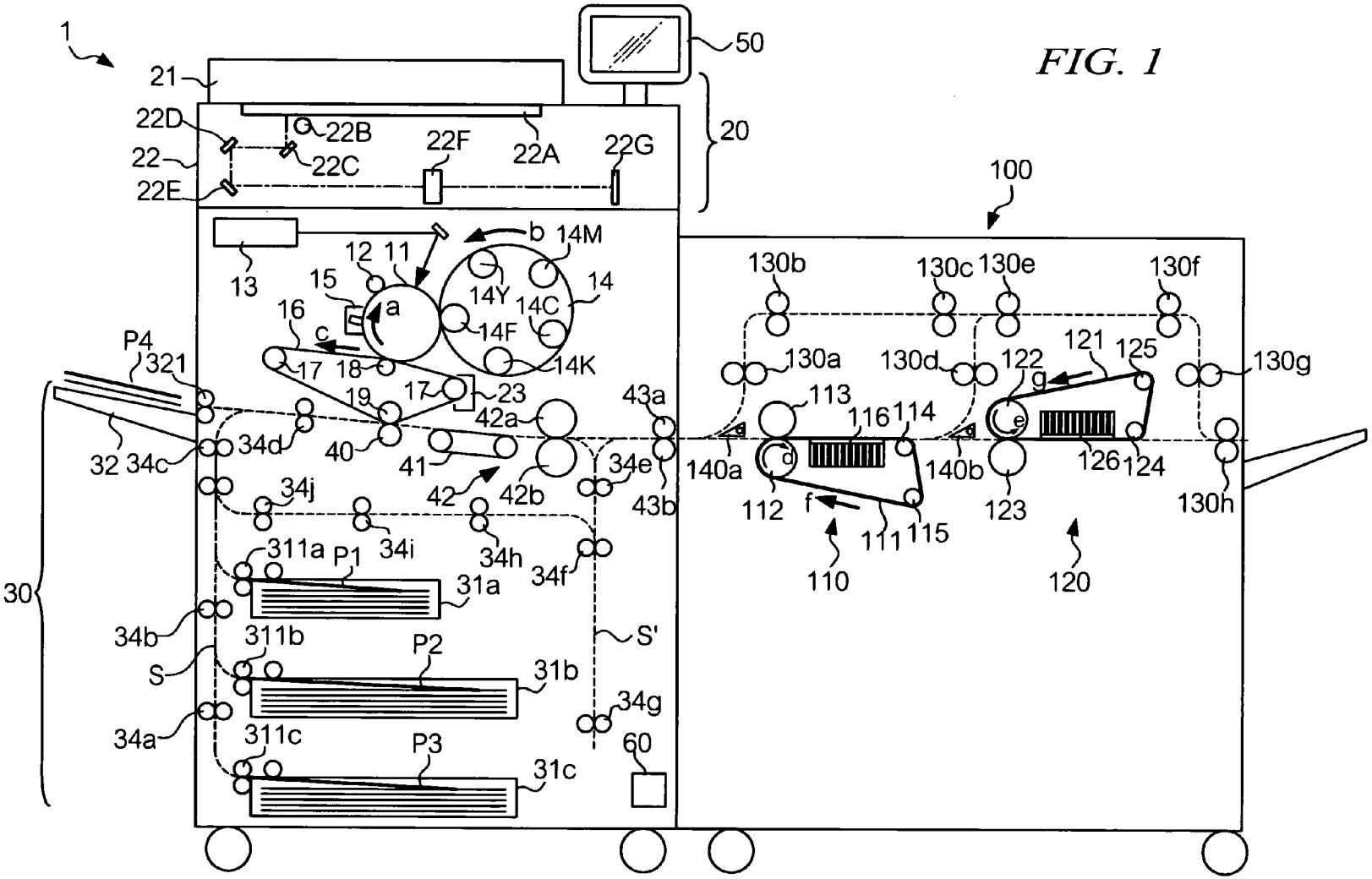
FIG. 1 shows a configuration of an image processing apparatus 1 according to an exemplified embodiment of the present invention

FIG. 1 shows a schematic configuration of an image forming apparatus 1 according to an exemplified embodiment of the present invention. As shown in FIG. 1, the image forming apparatus 1 includes an image forming unit 10, image reading unit 20, sheet feeder 30, control unit 60 which controls the units, and secondary fixing unit 100. A user interface 50 that enables a user to operate the image forming apparatus 1 is also provided with the image forming apparatus 1. Specifically, the user interface 50 includes a liquid crystal display for displaying a menu screen and messages that may assist a user's operation, and a touch panel integrated on the surface of the display. A user is able to input instructions to the image forming apparatus 1 via the touch panel. Alternatively, the user interface 50 may include an organic EL display or a Cathode Ray Tube (CRT).

The sheet feeder 30 is a sheet-supplying unit that includes sheet cassettes 31*a*, 31*b*, and 31*c*, and a sheet tray 32 and transfer rollers 34*a* to 34*d* that transfer a sheet (i.e. a medium for recording an image) from the sheet supplying unit to the image forming unit 10 along a sheet path S shown by a dotted line in the figure. The sheet path S includes a reverse sheet path S' for turning over a sheet when forming images on both faces of the sheet (i.e. double-sided printing). Transfer rollers 34*e* to 34*j* are provided on the sheet feeder 30 to transfer a sheet carried on reverse sheet path S' to the image forming unit 10. In the following description, a direction to the sheet-supplying unit on sheet path S is referred to as the upstream, and the direction opposite to the upstream is referred to as the downstream. Sheets P1, P2, and P3 which are stored in the cassettes 31*a*, 31*b*, and 32*b*, respectively are led one by one to sheet path S by feed rollers 311*a*, 311*b*, and 311*c* which are provided for the cassettes 31*a*, 31*b* and 31*c*, respectively. The sheet is then transferred to the image forming unit 10 by the transfer rollers 34*a* to 34*d*. Sheets P4 are placed on the sheet tray 32. Sheets P4 are supplied one by one to sheet path S by a feed roller 321.

Image reading unit 20 includes a document feeder 21 and a scanning unit 22 that scans a document to generate image data of the document. The document feeder 21 carries a document to a platen glass 22A of the scanning unit 22. Documents put in the document feeder 21 are transferred one by one to the platen glass 22A. After a scanning, a document on the platen glass 22A is forced out to a sheet-ejecting unit (not shown in the figure) provided with the document feeder 21.

The scanning unit 22 scans a document on the platen glass 22A carried by the document feeder 21 and generates an image of the document. The scanning unit 22 includes the platen glass 22A, a light source 22B, mirrors 22C, 22D, and 22E, a lens 22F, and an image pickup device 22G. A document on the platen glass 22A is exposed to light emitted from the light source 22B. The light reflected by the document is led by the mirrors 22C, 22D, and 22E to the lens 22F, and forms an images on the image pickup device 22G. The image pickup device 22G includes a charge-coupled device (CCD) which generates electric signals based on intensities of received light color components, i.e. red (R), green (G), and blue (B). The scanning unit 22 generates image data of the document based on the signals, and outputs the image data.

The image forming unit 10 forms an image on a sheet based on image data supplied by the control unit 60. Specifically, the image forming unit 10 includes a photoreceptor drum (image holding member) 11, charging device 12, exposure device 13, rotary developing unit 14, cleaning device 15, intermediate transfer belt 16, supporting roller 17, first transfer roller 18, second transfer roller 19, opposing roller 40, transfer belt 41, and fixing unit 42. A photosensitive material is applied to the outer surface of the photoreceptor drum 11. The photoreceptor drum 11 is driven by driving mechanism (not shown in the figure) in the direction shown by arrow a. The charging device 12 may adapt corotron charging or roller charging, which charging causes the surface of the photoreceptor drum 11 to a certain amount. The exposure device 13 is controlled to emit a laser according to supplied image data, so as to form a latent image on the surface of the photoreceptor drum 11.

The rotary developing unit 14 includes a developer which contains a toner 14F of a transparent color, as well developers 14Y, 14M, 14C, and 14K which contain toners of yellow (Y), magenta (M), cyan (C), and black (K), respectively. By rotation of the developing unit 14 in the direction shown by arrow b by a driving mechanism (not shown in the figure), the developers 14Y, 14M, 14C, 14K, and 14F can be moved to a position facing the photoreceptor drum 11. At this position, toner is transferred from the developer to the latent image by electrostatic force. Accordingly, a toner image is formed on the photoreceptor drum 11. In FIG. 1, there is shown a case where the developer that contains the transparent toner 14F is in the position facing the photoreceptor drum 11, so that a toner image of the transparent toner is formed on the surface of the photoreceptor drum 11. It is noted that the transparent toner is a toner that does not contain any colorants of yellow, magenta, cyan and black, as described in Japanese Patent Application JP2005-99122A.

The intermediate transfer belt 16 is an endless belt, mounted on the supporting rollers 17 with a certain tension, and on the first transfer roller 18, and the second transfer roller 19, so that the intermediate transfer belt 16 can be moved rotatably in the direction shown by arrow c. The first transfer roller 18 is provided at a position in an opposing relation to the photoreceptor drum 11, whereby the intermediate transfer belt 16 runs between the first transfer roller 18 and the photoreceptor drum 11. The first transfer belt 18 transfers a toner image formed on the photoreceptor 11 to the outer surface of the intermediate transfer belt 16 (first image transferring). The cleaning blade 15 provided in a vicinity of the photoreceptor drum 11 removes residual toner on the photoreceptor drum 11. The second transfer roller 19 is provided at a position in opposing relation to the opposing roller 40, whereby the intermediate belt 16 runs between the rollers 19 and 40, and transfers a toner image formed on the intermediate belt 16 to a sheet (second image transferring). Residual toner on the intermediate transfer belt 16 after the second image transferring is removed by the belt cleaner 23.

The fixing unit 42 includes a fixing roller 42*a* and pressure roller 42*b* opposing each other, between which sheet path S runs. The fixing roller 42*a* is a cylindrical member which includes a metal (ex. aluminum) core, elastic layer made of an elastic material (ex. silicon rubber) covering the core, and release layer made of PFA (tetra fluoro ethylene-perfluoro alkylvinyl ether copolymer) tube or the like formed on the elastic layer. A heat source such as a halogen lamp is housed in the core. The heat source is configured to heat the fixing roller 42*a* to maintain the surface temperature of the fixing roller at a predetermined value.

The pressure roller 42*b* is a roller member which includes a metal core, elastic layer covering the core, and release layer made of a PFA tube, pressing itself to the fixing roller 42*a* by means of a spring (not shown in the figure). When a sheet on which a toner image is formed is carried to a position between the fixing roller 42*a* and the pressure roller 42*b*, pressure and heat are applied to the sheet by the rollers 42*a* and 42*b*, respectively, to fix the toner image on the sheet.

Description will now be directed to a configuration of the secondary fixing unit 100. The secondary fixing unit 100 includes a first fixing unit 11 and second fixing unit 120, as shown in FIG. 1. Also, the secondary fixing unit 100 includes transfer roller pairs 130*a* to 130*h* and branching members 140*a* and 140*b* for selecting one of sheet paths.

The branching member 140*a*, under control of control unit 60, guides a sheet carried by the transfer rollers 43*a* and 43*b* in either a direction toward the transfer roller pair 130*a* or a direction toward the first fixing unit 110. The branching member 140*b*, under control of control unit 60, guides a sheet, which has passed through the first fixing unit 110, in either a direction toward the transfer roller pair 130*d* or a direction toward the second fixing unit 120.

The first fixing unit 110 performs additional fixing (post-fixing) on a toner image fixed on the lower face of a sheet. As shown in FIG. 1, the first fixing unit 110 includes a fixing belt 111, heat roller 112, pressure roller 113, separation roller 114, steering roller 115, and cooling member 116, so that the fixing belt heated by the heat roller 112 is cooled by the cooling member 116.

In the exemplified embodiment, the heat roller 112 includes a core, release layer, and halogen lamp. The core is, for example, cylindrical and is made of metal. Around the core, a release layer made of tetra fluoro ethylene resin such as polytetrafluoroethylene is provided. The halogen lamp is housed in the core, and is controlled by the control unit 60. The surface of the heat roller 112 is heated to a predetermined temperature by the heat roller 112. The heat roller 112 is rotated by a motor (not shown in the figure) in the direction shown by arrow d of FIG. 1.

The pressure roller 113 includes a core, release layer, and halogen lamp. The core is, for example, cylindrical and is made of metal. The elastic layer made of silicon rubber is provided around the core. For example, the hardness degree of the rubber in JIS-A standard is approximately 40. Around the elastic layer, the release layer made of tetra fluoro ethylene resin such as polytetrafluoroethylene is provided. The pressure roller 113 is provided above the opposing heat roller 112, whereby the fixing belt 121 runs between the pressure roller and the heat roller 112. The pressure roller 113 is, under control of control unit 60, rotatably moved in a direction opposite to a rotating direction of the heat roller 112.

The steering roller 115 is a roller that supports the fixing belt 111 and rotates in accordance with movement of the fixing belt. The steering roller 115 is configured to adjust an angle of the fixing belt 111 with respect to a direction vertical to its moving direction, so as to keep the fixing belt 111 running in the moving direction.

The separation roller 114 is cylindrical and rotates in accordance with rotatable movement of the fixing belt 111. A sheet on the fixing belt 111 is carried in close adhesion before reaching the separation roller 114. When the sheet is carried to the separation roller 114, the sheet separates from the fixing belt 111 due the stiffness of the sheet.

The fixing belt 111 is mounted on the heat roller 112, separation roller 114, and steering roller 115, and is rotatably moved according to rotation of the heat roller 112 in the direction shown by arrow f of FIG. 1. The fixing belt 111 includes a base layer and surface layer. The surface layer is formed on the base layer by silicon rubber, for example. The base layer is made of metal such as nickel, aluminum, or stainless steel.

It is possible to form the base layer with polybutylene terephthalate (PBT), polyimide, polyimide-amide, or other synthetic resin. In a case where synthetic resin is used for forming the base layer, fine conductive particles such as carbon black are added to the base layer, to decrease its volume resistively. In this case, less dust adheres to the base layer by electrostatic force.

The cooling member 116 cools the fixing belt 111 heated by the heat roller 112. The cooling member 116 is provided in the downstream of sheet path S with respect to the heat roller 112 (and pressure roller 113). The cooling member 116 maintains contacting with the fixing belt 111. The cooling member 116 is a heat sink made of metal having high thermal conductivity such as aluminum and copper, which includes fins to attain larger surface area, so as to improve heat dissipation.

The second fixing unit 120 performs additional fixing on a toner image fixed on the upper face of the sheet on which the additional fixing is performed by the first fixing unit. The second fixing unit 120 is provided in the downstream of sheet path S with respect to the first fixing unit 110. As shown in FIG. 1, the second fixing unit 120 includes fixing belt 121, heat roller 122, pressure roller 123, separation roller 124, steering roller 125, and cooling member 126, so as to cool the fixing belt 121 heated by the heat roller 122 using the cooling member 126. A configuration of the second fixing unit 120 is the same in elements but different in an arrangement of the elements, so as to perform re-fixing on the upper face of the sheet on sheet path S within the second fixing unit.

Specifically, the fixing belt is mounted by the heat roller 122, separation roller 124, and the steering roller 124, which are disposed above sheet path S. The heat roller 122 is rotated by a motor (not shown in the figure) in the direction as shown by arrow e. The fixing belt is rotatably moved in the direction as shown by arrow g according to rotation of the heat roller 122. The cooling member 126 is disposed in the downstream of sheet path S with respect to the heat roller 122, contacting the inner surface of the fixing belt 121. The pressure roller 123 is disposed under the heat roller 122 contacting the fixing belt 121. The pressure roller 123 can be rotated, under control of control unit 60, by a driving mechanism (not shown in the figure) in directions the same as and opposite to a rotating direction of the heat roller 122.

Figure 2:
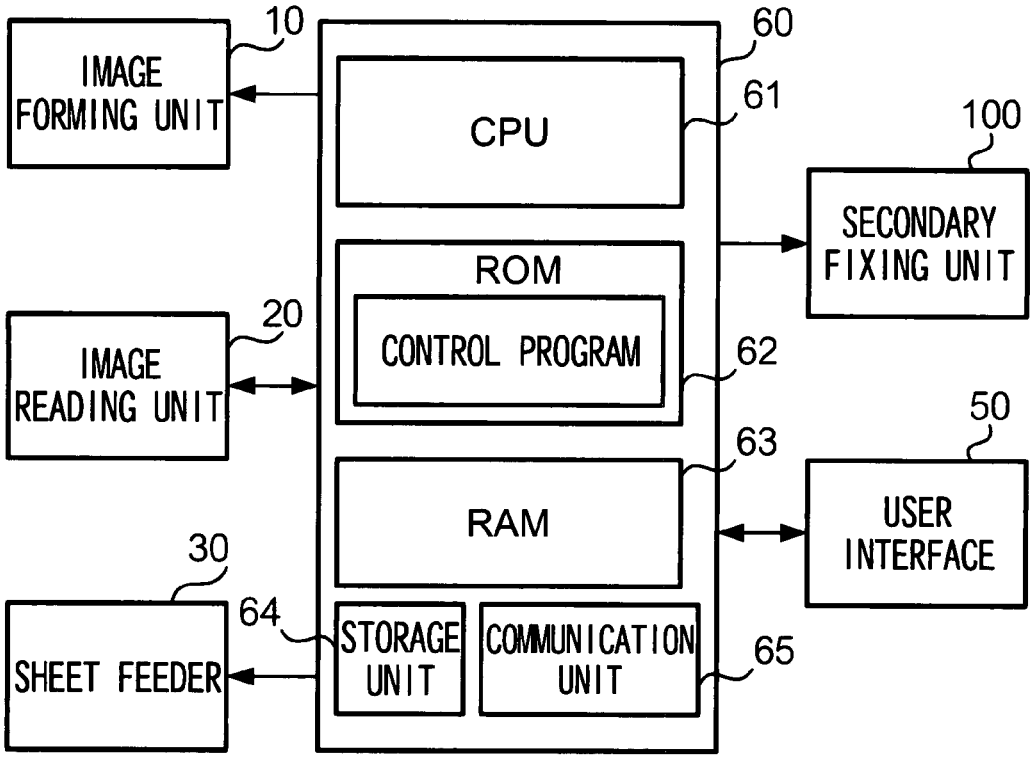
FIG. 2 shows a configuration of a controlling unit of the image processing apparatus 1 according to the exemplified embodiment.

A configuration of the control unit 60 that controls all elements of the image forming apparatus 1 will now be described. FIG. 2 is a block diagram showing a hardware configuration of the image forming apparatus 1. The control unit 60 is connected to the image forming unit 10, the image reading unit 20, the sheet feeder 30, the user interface 50, and the secondary fixing unit 100. The control unit 60 includes a CPU 61, ROM 62, and RAM 63. The ROM 62 stores a control program executable by the CPU 61. The CPU 61 reads from the ROM 62 executes the control program using the RAM 63 as a work area. When the control program is executed, the control unit 60 controls the image forming unit 10, the image reading unit 20, the sheet feeder 30, the user interface 50, and the secondary fixing unit 100, so as to perform copying or printing.

The control unit 60 includes a storage unit 64 and communication unit 65. The communication unit 65 is connected to a communication network such as a Local Area Network (LAN) to receive image data transmitted by a server or PC via the network. The storage unit 64 includes a hard disk drive to store image data generated by the image reading unit 20 or received by the communication unit 65.

Operation

Description will now be directed to an operation of the exemplary embodiment.

When a communication unit 65 receives image data via a communication network and an instruction as to whether to use the secondary fixing unit 100, the image data and the instruction are stored in the storage unit 64. It is assumed for the sake of explanation that the image data represents an image in which multiple colors are used. Next, control unit 60 generates images for each of colors, i.e. yellow, magenta, cyan, and black based on the image data stored in the storage unit 65, and generates an image for each of the colors.

The control unit 60 forms toner image for yellow, magenta, cyan, and black based on the generated image data. Specifically, the image data of yellow is output to the exposure device 13. Upon receipt of the image data, the control unit 60 rotates the photoreceptor drum 11 and causes the exposure device 13 to start scanning a laser on photoreceptor drum 11 in a main and sub scanning directions at predetermined starting points. The scanning is performed based on the image data, thus a latent image of the image data is formed on the surface of the photoreceptor drum 11. Next, the control unit 60 rotates the rotary developing unit 14, so that the developer 14Y faces toward the photoreceptor drum 11, and forms a toner image of yellow on the photoreceptor drum 11. Next, the control unit 60 drives the intermediate transfer belt 16 and rotates the photoreceptor drum 11, to transfer the toner image formed on the photoreceptor drum 11 to the outer surface of the intermediate transfer belt 16.

The control unit 60, after the toner image of yellow is transferred to the intermediate transfer belt 16, outputs image data of magenta to the exposure device 13. Upon receipt of the image data of magenta, the exposure device 13 emits a laser based on the received image data, to form a latent image on the surface of the photoreceptor drum 11. Next, the control unit 60 rotates the rotary developing unit 14 so that the developer 14M faces toward the photoreceptor drum 11, and then rotates the photoreceptor drum 11 to form a toner image of magenta on the photoreceptor drum 11. Next, the control unit 60 drives the intermediate transfer belt 16 and rotates the photoreceptor drum 11, so as to transfer the toner image formed on the photoreceptor drum 11 to the intermediate transfer belt 16. It is noted that the toner image of magenta is superimposed on the toner image of yellow.

After the toner image of magenta is transferred to the intermediate transfer belt 16, the control unit 60 forms a toner image and transfers to the intermediate transfer belt 16 for images of cyan and black, similary to the cases of yellow and magenta.

After the toner images of yellow, magenta, cyan, and black are transferred to the intermediate transfer belt 16, the control unit 60 forms a toner image of the transparent toner. Specifically, the control unit 60 outputs to the exposure device 13 image data representing an image having a size larger than the sheet on which the toner image of the above colors are formed. Upon receipt of the image data, the exposure device 13 emits laser based on the received image data, to form a latent image on the surface of the photoreceptor drum 11. Next, the control unit 60 rotates the rotary developing unit 14F so that the developer 14F faces toward the photoreceptor drum 11, and rotates the photoreceptor drum 11, to form a toner image of the transparent toner on the photoreceptor drum 11. Next, the control unit 60 drives the intermediate transfer belt 16, and rotates the photoreceptor drum 11, so as to transfer the transparent toner image formed on the photoreceptor drum 11 to the intermediate transfer belt 16. The transparent toner image is superimposed on the toner images of yellow, magenta, cyan, and black.

The control unit 60 controls the sheet feeder 30 to carry a sheet P1 to a position of the transfer roller 34*d*. Next, the control unit 60 drives the intermediate transfer belt 16 and carries sheet P1 to a position of the opposing roller 40, so as to transfer a toner image formed on the intermediate belt 16 to sheet P1. Sheet P1 on which the toner image is formed is carried by the transfer belt 42 to the fixing unit 41 at which the sheet is pressed and heated. As a result, the toner image is fixed on sheet P1.

In a case that an image should be formed only on one face of sheet P1, control unit 60 carries sheet P1 on which the toner image is fixed in the direction toward the transfer roller 34*e*. When sheet P1 is caused to stand perpendicularly in sheet path S', sheet P1 is carried out of sheet path S' to the transfer rollers 43*a* and 43*b*, to turn sheet P1 upside down. As a result, the toner image fixed on sheet P1 faces downward as shown in FIG. 1 when passing between the transfer rollers 43*a* and 43*b*.

In a case that images should be formed on both faces of sheet P1, sheet P1 on which a toner image has been fixed on one face is brought to sheet path S'. The control unit 60 generates image data for each of yellow, magenta, cyan, and black based on another image data to be formed on the other face of sheet P1, which is stored in the storage unit 64. Similarly to the case of forming an image on one face, the control unit 60 fixes another toner image on the other face of sheet P1. Sheet P1 is then carried to the transfer rollers 43*a* and 43*b*.

Sheet P1 carried between the transfer rollers 43*a* and 43*b* is further carried to the secondary fixing unit 100. When the instruction stored in the storage unit 64 instructs not to use the secondary fixing unit 100, control unit 60 causes the branching member 140*a* to guide sheet P1 in the direction toward the transfer roller pair 130*a*. Next, sheet P1 is carried by the transfer roller pairs 130*b*, 130*c*, 130*e*, 130*f*, 130*g*, and 130*h*, so as to be ejected from the secondary fixing unit 100.

When the instruction stored in the storage unit 64 instructs to use the secondary fixing unit 100, the control unit 60 causes the branching unit 140*a* to guide sheet P1 in the direction toward the first fixing unit 110. Sheet P1 is then carried to the fixing belt 111 and the pressure roller 113. While sheet P1 passes between the pressure roller 113 and the fixing belt 111, sheet P1 is pressed and heated by the heat roller 112 and the pressure roller 113, since the pressure roller 113 is pressed to the fixing belt 111. Colorant forming toner image on the lower face of sheet P1 melts; thus, sheet P1 adheres to the fixing belt 111.

Since the fixing belt 111 rotatably moves according to a rotation of the heat roller 112 and sheet P1 adheres to the fixing belt 111, sheet P1 is carried toward the separation roller 114 together with belt 111. When a portion of sheet P1 reaches a position above the cooling member 116, the portion is cooled by the cooling member 116.

The cooled portion of sheet P is carried by the fixing belt 111 to the separation roller 114. When sheet P1 reaches the separation roller 114, sheet p1 separates from the fixing belt 111 due to its stiffness and is therefore carried toward the branching member 140*b*.

When a toner image has been formed only on one face of sheet P1, control unit 60 causes the branching member 140*b* to guide sheet P1 toward the transfer roller pair 130*d*. Next, sheet P1 is carried by the transfer roller pairs 130*e*, 130*f*, 130*g*, and 130*h* and is finally ejected from the secondary fixing unit 100.

When toner images have been formed on both faces of sheet P1, the control unit 60 causes the branching member 140*b* to guide sheet P1 toward the second fixing unit 120. Sheet P1 is then carried to the fixing belt 121 and the pressure roller 123. While sheet P1 passes between the pressure roller 123 and the fixing belt 121, sheet P1 is pressed and heated by the heat roller 122 and the pressure roller 113, since the pressure roller 123 is pressed to the fixing belt 121. Colorant forming toner image on the upper face of sheet P1 melts; thus, sheet P1 adheres to the fixing belt 121.

Since the fixing belt rotatably moves according to a rotation of the heat roller 122 and sheet P1 adheres to the fixing belt 121, sheet P1 is carried toward the separation roller 124 together with belt 121. When a portion of sheet P1 reaches a position above the cooling member 116, the portion is cooled by the cooling member 126.

The cooled portion of sheet P1 is carried by the fixing belt 121 to the separation roller 124. When sheet P1 reaches the separation roller 114, sheet p1 separates from the fixing belt 111 due to its stiffness, and is therefore carried toward the transfer roller pair 130*h*. Finally, sheet P1 is ejected from the secondary unit 100 by the transfer roller pair 130*h*.

The foregoing description of the embodiments and of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

Modifications

Modifications of the exemplary embodiment are described below. In the exemplary embodiment, members for pressing and separating a sheet are cylindrical rollers; however, it is possible to employ members having another shape for allowing the fixing belt mounted on the members to rotatably move.

Figure 3:
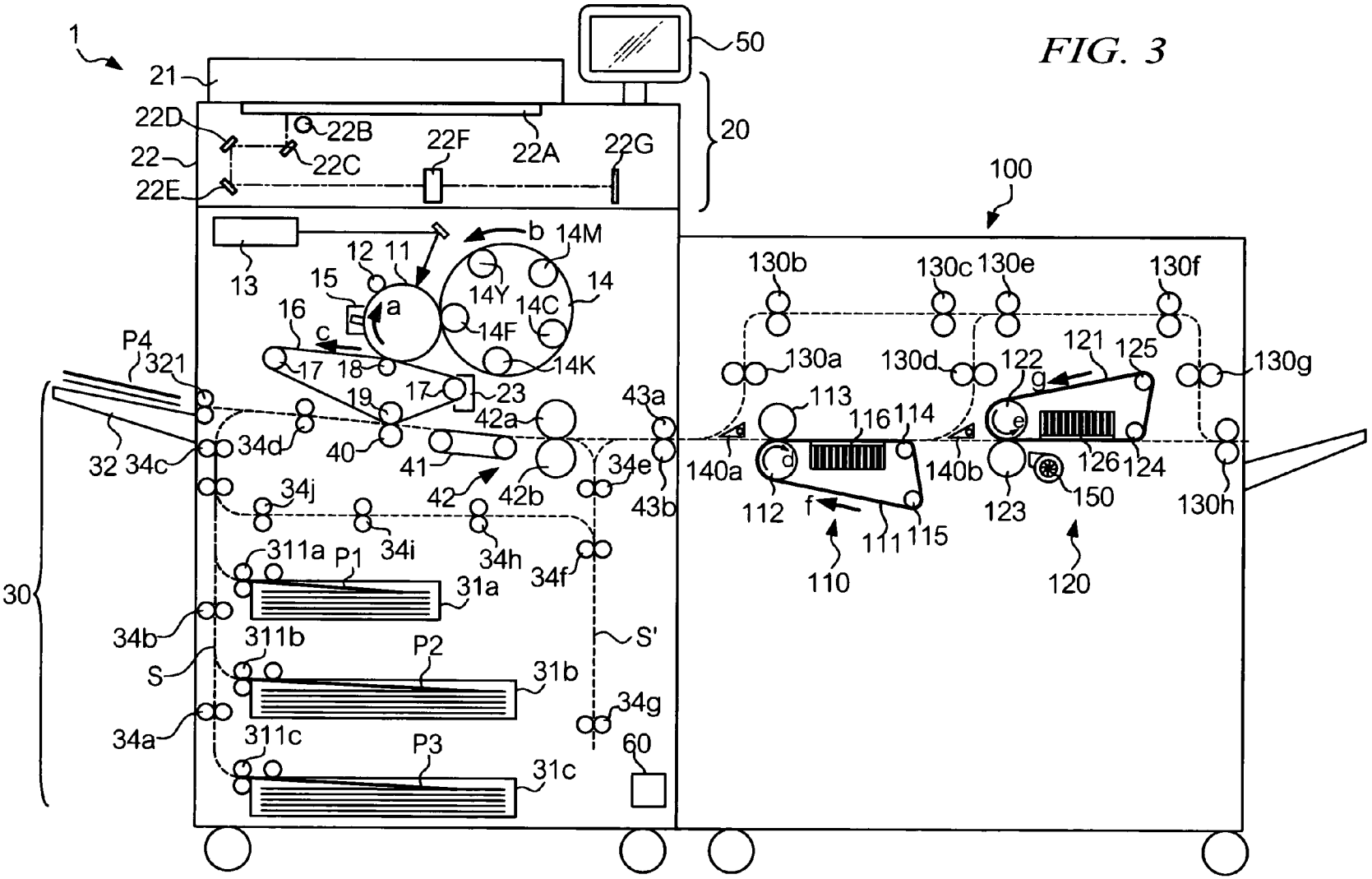
FIG. 3 shows an image processing apparatus according to a modification of the exemplified embodiment.
Figure 4:
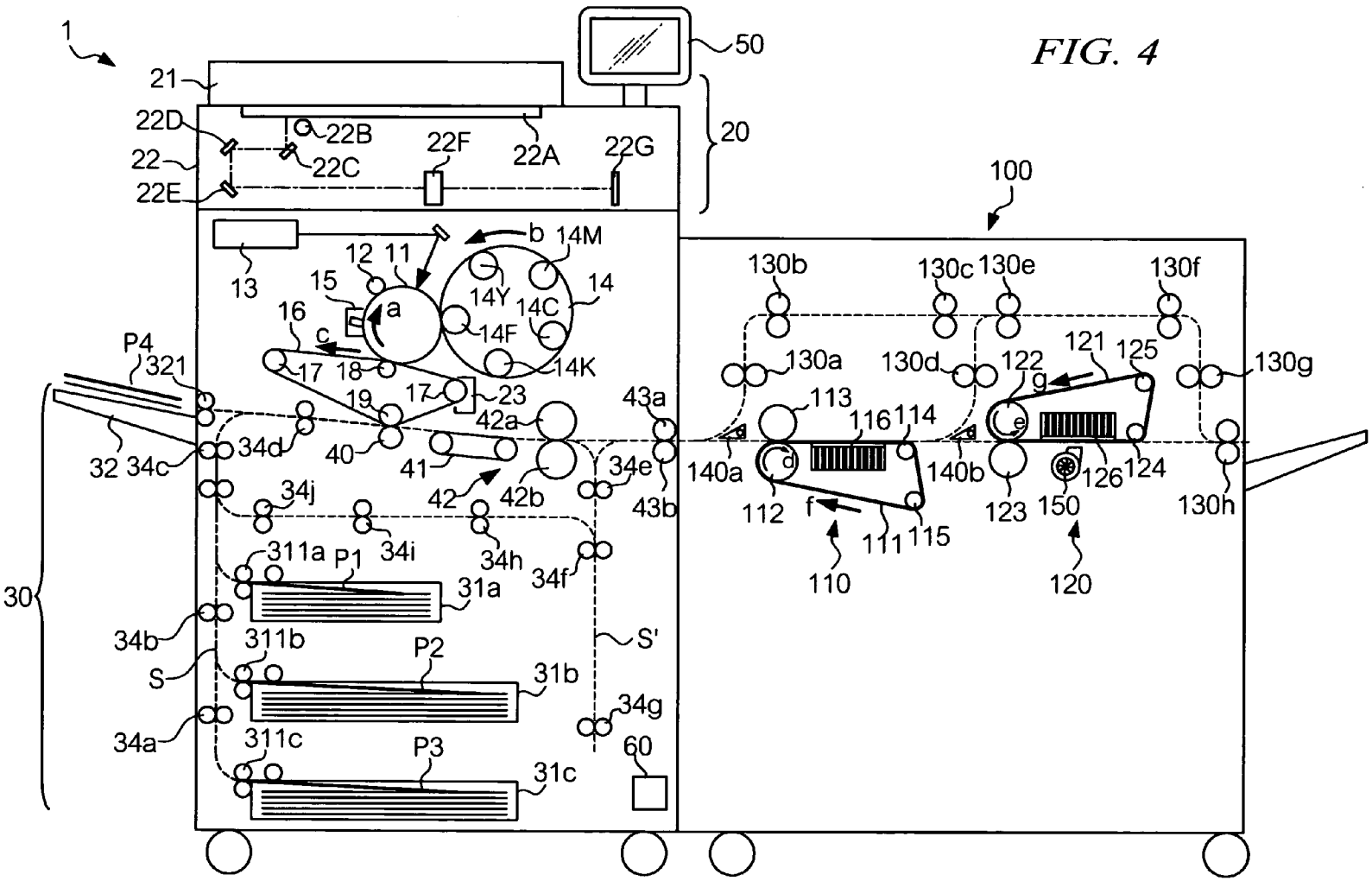
FIG. 4 shows an image processing apparatus according to another modification of the exemplified embodiment.

It is possible to provide a fan 150 for cooling the pressure roller 123 by supplying a current of air to the pressure roller 123 of the second fixing unit 120, as shown in FIG. 3. Alternatively, the fan 150 may face toward the fixing belt 121 to cool the fixing belt 121, as shown in FIG. 4. It is possible to cool the pressure roller 123 by allowing airflow to pass though in the pressure roller 123. Alternatively, it is possible to circulate a fluid in the pressure roller to cool the pressure roller 123.

It is possible to set a pressure of the pressure roller 123 to the heat roller 122 to be smaller than a pressure of the pressure roller 113 to the heat roller 112. It is possible to adjust a speed of the fixing belt 121 of the second fixing unit 120 to be faster than a speed of the fixing belt 111 of the second fixing unit 110.

Figure 5:
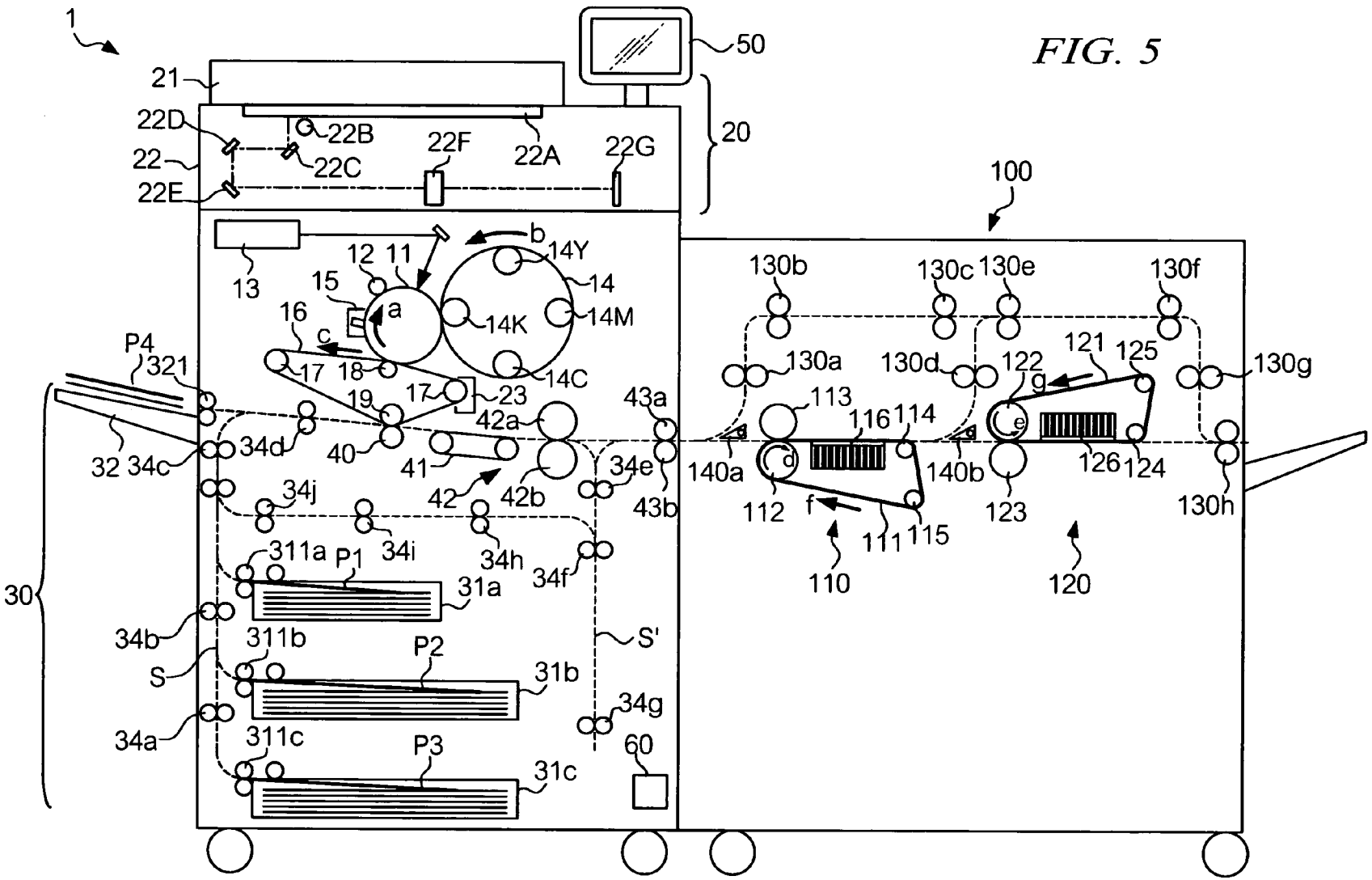
FIG. 5 shows an image processing apparatus according to yet another modification of the exemplified embodiment.

It is possible to employ a tandem type developing unit instead of the rotary type developing unit of the exemplary embodiment. It is possible to omit the transparent toner in the developing device, as shown in FIG. 5. A transparent resin layer may be constituted on the surface of the sheet. It is possible to provide a sheet on which an image is formed in advance, and to set the sheet in the sheet tray 32. In the image forming apparatus 1 the transparent toner is transferred to both faces of the sheet, and re-fixing is performed on the sheet in the secondary fixing unit 100. In this case, the image can be formed using ink or other colorants as well as toner. The image forming unit 10 may have only a developer for containing the transparent toner.

In the second fixing unit 120 it is possible to adjust a temperature of a sheet which has passed between the heat roller 122 and the pressure roller 123 to be lower than a temperature of the sheet which has passed between the heat roller 112 and the pressure roller 113. Specifically, at least one parameter(s) for the second fixing unit 120, including a pressure of the pressure roller 123 to the heat roller, contacting area of the pressure roller 123 to the heat roller, a time period during which the fixing belt 121 remains in the contacting area, and the temperature of the heat roller 112 may be adjusted to be smaller than that of the first fixing unit 110. It is noted that "a temperature of the sheet which has passed through between a heat roller and a pressure roller" means a temperature measured at a position between a contact area and a neighboring cooling member.

Figure 6:
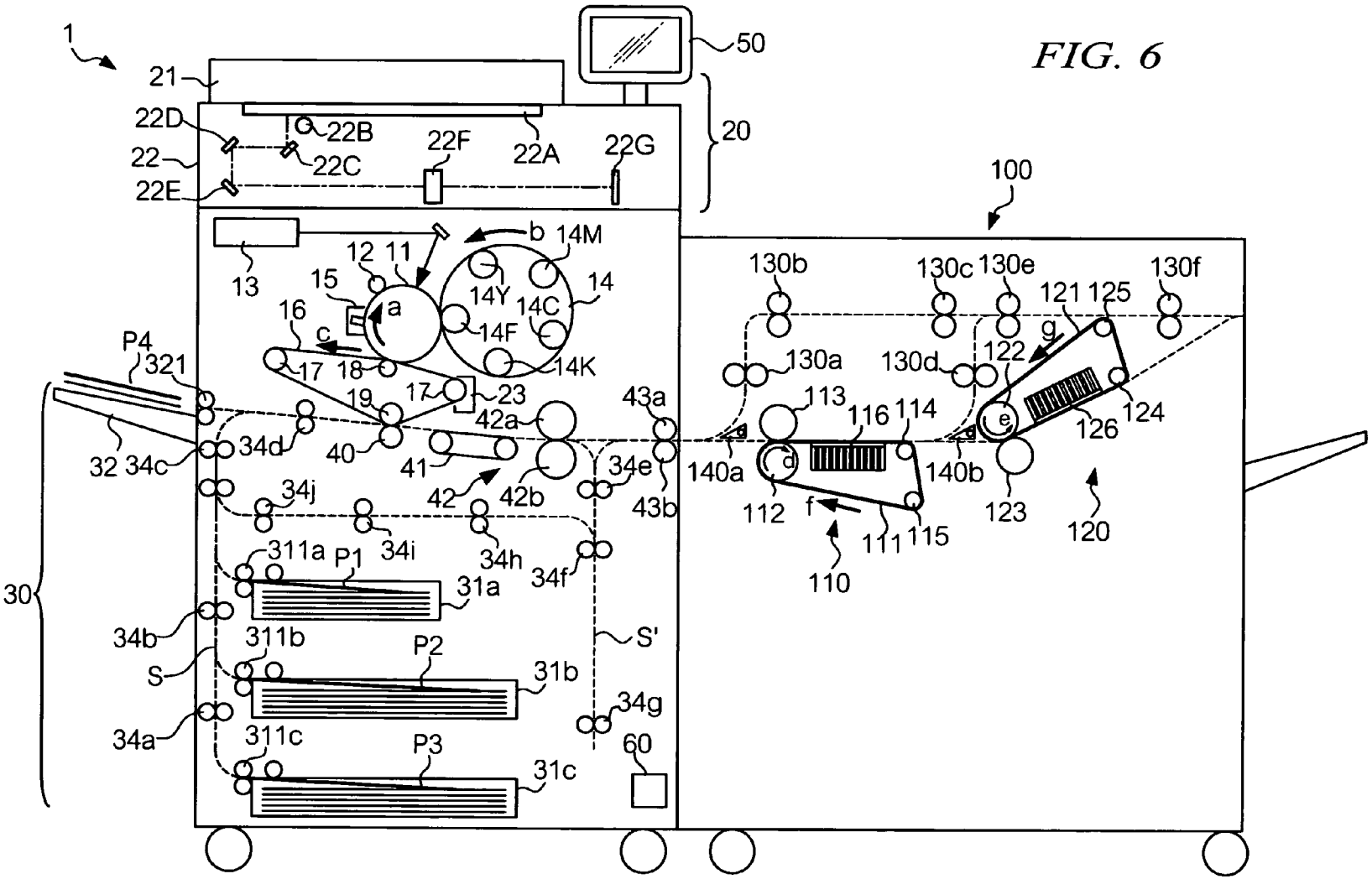
FIG. 6 shows an image processing apparatus according to yet another modification of the exemplified embodiment.

The sheet path of the secondary unit 120 is not necessarily horizontal, as shown in FIG. 6. In this case, the heat roller 122 and the pressure roller 123 of the second fixing unit 120 are aligned so that a vertical position of a rotation axis of the pressure roller 123 is lower than a vertical position of a rotation axis of the heat roller 122. The heat rollers, seating rollers, and separation rollers may be other than cylindrical, and may have a shape that allows the fixing belt mounted on the members to rotatably move. It is possible to omit a steering roller in a case where a fixing belt can be mounted on only a heat roller and separation roller.

What is claimed is:

1. A fixing apparatus comprising:

a first fixing unit; and a second fixing unit, the first fixing unit comprising:

a first heating member, that includes a heat source and rotates;

a first fixing belt, rotatably contacted with the first heating member, that carries a sheet, contacting a face of the sheet, on which face an image is formed;

a first pressure member that is provided in opposing relation to the first heating member and is pressed to the first fixing belt, the first fixing belt being sandwiched by the first pressure member and the first heating member;

a first separation member contacting the first fixing belt, that separates the sheet carried by the first fixing belt from the first fixing belt; and a first cooling member, disposed between the first separation member and the first heating member, that cools the first fixing belt by contacting the first fixing belt;

the second fixing unit comprising:

a second heating member, provided in a downstream of a sheet path with respect to the first fixing unit, that includes a heat source and rotates;

a second fixing belt, rotatably contacted with the second heating member, that carries a sheet, contacting another face of the sheet, a second pressure member, provided in opposing relation to the second heating member, that is pressed to the second fixing belt, the second fixing belt being sandwiched by the second pressure member and the second heating member, a vertical position of a rotation axis of the second pressure member being lower than a vertical position of a rotation axis of the second heating member;

a second separation member contacting the second fixing belt, that separates the sheet carried by the second fixing belt from the second fixing belt; and a second cooling member, disposed between the second separation member and the second heating member, that cools the second fixing belt by contacting the second fixing belt.

2. The fixing apparatus according to claim 1, wherein a temperature of the sheet after passing between the second heating member and the second pressure member is lower than a temperature of the sheet after passing between the first heating member and the first pressure member.

3. The fixing apparatus according to claim 1, further comprising a third cooler member that cools the second pressure member.

4. The fixing apparatus according to claim 1, further comprising a fourth cooler member that cools the sheet being carried by the second fixing belt.

5. A post-processing apparatus comprising:

an image processing unit;

a first post-fixing unit; and a second post-fixing unit, the image processing unit comprising;

a transparent layer generating unit that forms a transparent layer on a face of a sheet, on which face an image is formed by a colorant, the transparent layer including fine transparent particles;

a pre-fixing unit that fixes the transparent layer generated by the transparent layer generating unit on the sheet;

the first post-fixing unit comprising:

a first heating member that includes a heat source and rotates;

a first fixing belt, rotatably contacted with the first heating member, that carries a sheet, contacting a face of the sheet, on which face the transparent layer is fixed by the pre-fixing unit;

a first pressure member, provided in opposing relation to the first heating member, that is pressed to the first fixing belt, the first fixing belt being sandwiched by the first pressure member and the first heating member;

a first separation member contacting the first fixing belt, that separates the sheet carried by the first fixing belt from the first fixing belt; and a first cooling member, disposed between the first separation member and the first heating member, that cools the first fixing belt by contacting the first fixing belt;

the second post-fixing unit comprising:

a second heating member provided in a downstream of a sheet path with respect to the first post-fixing unit, that includes a heat source and rotates;

a second fixing belt, rotatably contacted with the second heating member, that carries a sheet, contacting another face of the sheet, a second pressure member, provided in opposing relation to the second heating member, that is pressed to the second fixing belt, the second fixing belt being sandwiched by the second pressure member and the second heating member, a vertical position of a rotation axis of the second pressure member being lower than a vertical position of a rotation axis of the second heating member;

a second separation member contacting the second fixing belt, that separates the sheet carried by the second fixing belt from the second fixing belt; and a second cooling member, disposed between the second separation member and the second heating member, that cools the second fixing belt by contacting the second fixing belt during moving.

6. An image forming apparatus comprising:

an image processing unit;

a first post-fixing unit; and a second post-fixing unit, the image processing unit comprising:

an image generation unit that forms, based on image data, an image on a sheet using a colorant;

a transparent layer generating unit that forms a transparent layer on a face of a sheet, on which face an image is formed by the image generation unit, the transparent layer including fine transparent particles;

a pre-fixing unit that fixes the image formed by the image generation unit and the transparent layer generated by the transparent layer generating unit on the sheet;

the first post-fixing unit comprising:

a first heating member, being rotatable, that includes a heat source;

a first fixing belt, rotatably contacted with the first heating member, that carries a sheet, the first fixing belt contacting a face of the sheet, on which face the transparent layer is fixed by the pre-fixing unit;

a first pressure member, provided in opposing relation to the first heating member, that is pressed to the first fixing belt, the first fixing belt being sandwiched by the first pressure member and the first heating member;

a first separation member mounting the first fixing belt, that separates the sheet carried by the first fixing belt from the first fixing belt; and a first cooling member, disposed between the first separation member and the first heating member, that cools the first fixing belt by contacting the first fixing belt;

the second post-fixing unit comprising:

a second heating member provided in a downstream of a sheet path with respect to the first post-fixing unit, that includes a heat source and rotates;

a second fixing belt, rotatably contacted with the second heating member, that carries a sheet, contacting an other face of the sheet, a second pressure member, provided in opposing relation to the second heating member, that is pressed to the second endless belt, the second endless belt being sandwiched by the second pressure member and the second heating member, a vertical position of a rotation axis of the second pressure member being lower than a vertical position of a rotation axis of the second heating member;

a second separation member contacting the second fixing belt, that separates the sheet carried by the second fixing belt from the second fixing belt; and a second cooling member, disposed between the second separation member and the second heating member, that cools the second fixing belt by contacting the second fixing belt.

* * * * *